US009947463B2

(12) United States Patent
Akimoto

(10) Patent No.: US 9,947,463 B2
(45) **Date of Patent: *Apr. 17, 2018**

(54) IGNITION COIL FOR INTERNAL COMBUSTION ENGINE

(71) Applicant: DENSO CORPORATION, Kariya, Aichi-pref. (JP)

(72) Inventor: Katsunori Akimoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/227,191

(22) Filed: Aug. 3, 2016

(65) Prior Publication Data

US 2017/0040104 A1 Feb. 9, 2017

(30) Foreign Application Priority Data

Aug. 7, 2015 (JP) ..... 2015-156951

(51) Int. Cl.

| | |
|---|---|
| ***H01F 38/12*** | (2006.01) |
| ***F02P 3/02*** | (2006.01) |
| ***H01T 13/44*** | (2006.01) |
| ***H01F 27/02*** | (2006.01) |

(52) U.S. Cl.

CPC ..... *H01F 38/12* (2013.01); *F02P 3/02* (2013.01); *H01F 27/022* (2013.01); *H01T 13/44* (2013.01)

(58) Field of Classification Search

CPC ... F02P 3/02; F02P 15/00; H01F 38/12; H01F 27/022; H01T 13/44

USPC ..... 123/143 B, 630, 632–635, 642, 650; 336/65, 107, 192, 198, 220–223

See application file for complete search history.

(56) References Cited

U.S. PATENT DOCUMENTS

| | | | | |
|---|---|---|---|---|
| 5,419,300 | A * | 5/1995 | Maruyama | F02P 3/02 123/634 |
| 5,781,092 | A | 7/1998 | Nakamichi et al. | |
| 7,036,495 | B1 | 5/2006 | Shimizu | |
| 2006/0260591 | A1 * | 11/2006 | Iwa | F02P 3/02 123/634 |
| 2012/0222660 | A1 | 9/2012 | Idogawa et al. | |
| 2016/0115935 | A1 * | 4/2016 | Tada | F02P 3/04 315/209 T |

(Continued)

FOREIGN PATENT DOCUMENTS

| | | |
|---|---|---|
| JP | H07-109810 | 4/1995 |
| JP | 2001-023840 | 1/2001 |
| JP | 2002-184630 | 6/2002 |

(Continued)

*Primary Examiner* — John Kwon
*Assistant Examiner* — Johnny H Hoang
(74) *Attorney, Agent, or Firm* — Nixon & Vanderhye P.C.

(57) ABSTRACT

An ignition coil for internal combustion engines is provided which includes magnetically coupled primary and secondary coils, a case, a high-voltage tower, a resistor, and resin packed in the case. The case has the primary coil and the secondary coil disposed therein. The high-voltage tower is attached to a tower mount formed on a front end of the case. The resistor is embedded in the high-voltage tower with a front and a base end surfaces thereof exposed from the high-voltage tower. The resin is packed in the case to seal the primary coil and the secondary coil. This structure enhances the productivity of an assembly of the high-voltage tower and the resistor.

4 Claims, 6 Drawing Sheets

(56) References Cited

U.S. PATENT DOCUMENTS

2016/0211072 A1* 7/2016 Kawai ..... H01F 38/12

FOREIGN PATENT DOCUMENTS

| | | |
|---|---|---|
| JP | 2003-142326 | 5/2003 |
| JP | 2006-049478 | 2/2006 |
| JP | 2009-121383 | 6/2009 |
| JP | 2011-100758 | 5/2011 |

* cited by examiner

IGNITION COIL FOR INTERNAL COMBUSTION ENGINE

CROSS REFERENCE TO RELATED DOCUMENT

The present application claims the benefit of priority of Japanese Patent Application No. 2015-156951 filed on Aug. 7, 2015, the disclosure of which is incorporated herein by reference.

BACKGROUND

1. Technical Field

This disclosure relates generally to an ignition coil for an internal combustion engine.

2. Background Art

For instance, Japanese Patent First Publication No. 2006-49478 discloses an ignition coil which includes a primary coil, a secondary coil, and a case. The case includes a coil storage casing in which the primary and secondary coils are disposed and a high-voltage tower which extends from the coil storage casing. The high-voltage tower has a resistor which works to minimize noise current generated by a spark plug joined to the ignition coil. The resistor is insert-molded in the high-voltage tower, thereby reducing mechanical stress acting on the high-voltage tower and the resistor as compared with when the resistor is press-fit in the high-voltage tower.

The case is assembled by first placing the resistor in a cavity of a mold made up of a plurality of discrete blocks, injecting molten resin into the mold, and then cooling or solidifying the resin.

The above ignition coil, however, faces the drawback in that the high-voltage tower and the coil storage casing are formed integrally as the case, thus requiring a large size and a complicated shape of the mold to form the case. The case is made by insert-molding the resistor in the high-voltage tower, thus requiring a more complex structure of the mold, which will disturb the productivity of the ignition coil.

SUMMARY

It is therefore an object to provide an ignition coil for internal combustion engines which is designed to improve the productivity of an assembly of a high-voltage tower and a resistor embedded in the high-voltage tower.

According to one aspect of the invention, there is provided an ignition coil for an internal combustion engine which comprises: (a) a primary coil and a secondary coil which are magnetically coupled together; (b) a case in which the primary coil and the secondary coil are disposed, the case having a front end and a base end which are opposed to each other, the casing also having a tower mount formed on the front end thereof; (c) a high-voltage tower which is secured to the tower mount of said case; (d) a resistor which has a front end surface and a base end surface which are opposed to each other, the resistor being embedded in the high-voltage tower with the front and base end surfaces exposed from the high-voltage tower; and (e) resin which is packed within the case to seal the primary coil and the secondary coil.

The ignition coil is, as described above, designed to have the high-voltage tower attached to the tower mount formed on the front end of the case. This enables the high-voltage tower to be formed to have the resistor embedded therein separately from the case, thus making it possible to produce the assembly of the high-voltage tower and the resistor to be reduced in size as compared with when the high-voltage tower in which the resistor is embedded is formed integrally with the case. The structure of the high-voltage tower in which the resistor is installed may, therefore, be designed to be compact and simplified, which will enable the assembly of the high-voltage tower and the resistor to be fabricated in a decreased number of production processes to improve the productivity of the ignition coil.

It is also possible to reduce the size of a mold used to form the assembly of the high-voltage tower and the resistor, thereby enhancing the mechanical strength of the high-voltage tower. Specifically, a cavity of the mold for forming the high-voltage tower in which the resistor is embedded is enabled to be reduced in size and simplified in structure thereof. This minimizes the risk that welds appear when molten resin is poured into the cavity of the mold to form the high-voltage tower, thus resulting in an increased mechanical strength of the high-voltage tower, which will lead to improved durability of the high-voltage tower against stress arising from a difference in coefficient of linear expansion between the high-voltage tower and the resistor.

The enhanced strength of the high-voltage tower also enables the high-voltage tower to be reduced in size itself.

The structure ignition coil of this disclosure is, therefore, engineered to have the resistor disposed within the high-voltage tower and enhances the productivity of the ignition coil.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENT

First Embodiment

Figure 1:
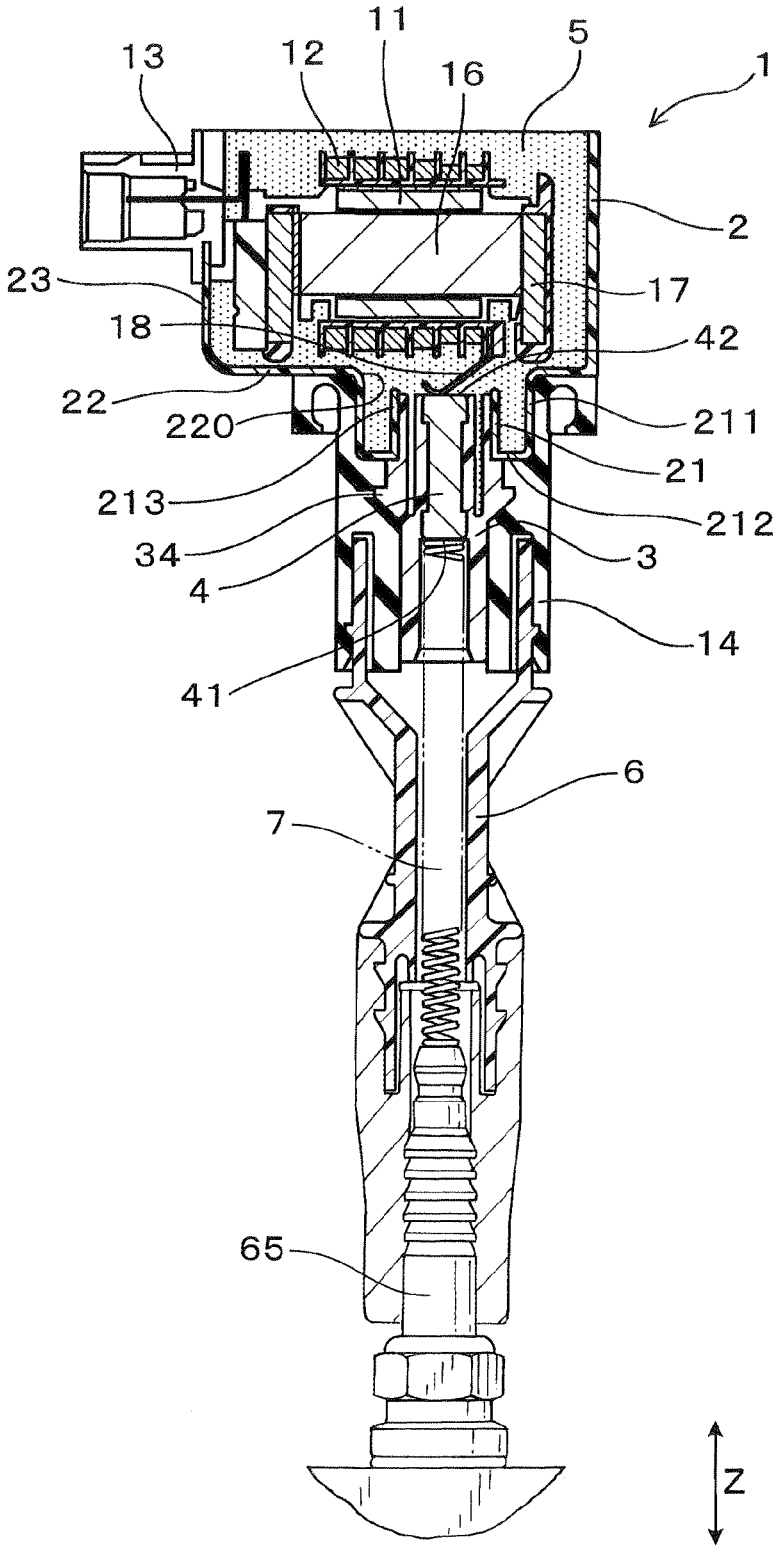
FIG. 1 is a longitudinal sectional view which illustrates an ignition coil according to the first embodiment.

Referring to the drawings, wherein like reference numbers refer to like parts in several views, particularly to FIGS. 1 to 4, there is shown an ignition coil 1 for internal combustion engine according to the first embodiment.

Figure 2:
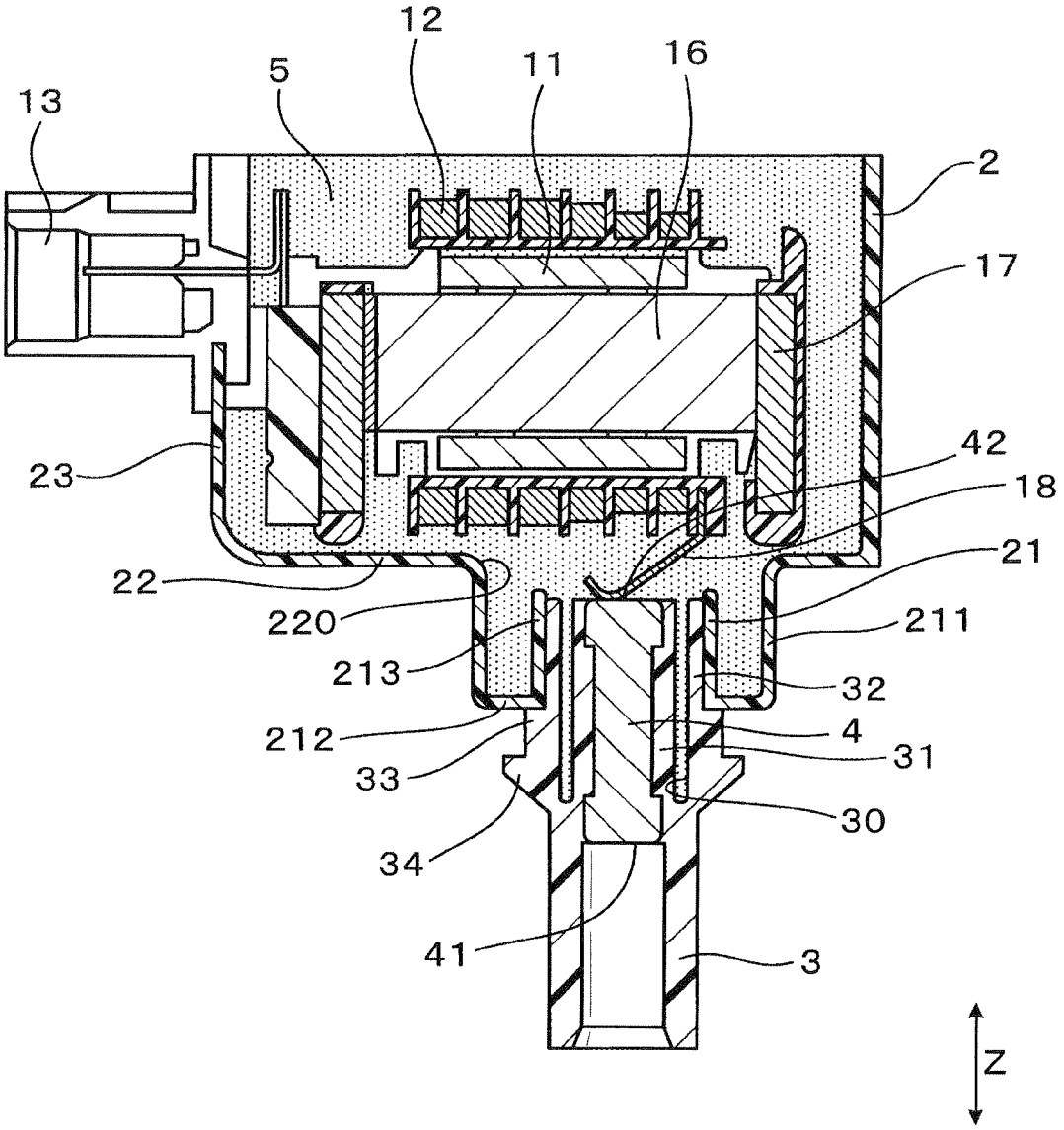
FIG. 2 is a sectional view which illustrates the ignition coil of FIG. 1 from which a joint is emitted.

The ignition coil 1, as clearly illustrated in FIGS. 1 and 2, includes the primary coil 11 and the secondary coil 12 which are magnetically coupled together, the case 2, the high-voltage tower 3, the resistor 4, and the filled resin 5. The case 2 has the primary coil 11 and the secondary coil 12 disposed therein. The high-voltage tower 3 is fit in the tower mount 21 formed on a front end portion (i.e., a lower portion, as viewed in FIGS. 1 and 2) of the case 2. The resistor 4 has a given length with a front end surface 41 and a base end surface which are opposed to each other. The resistor 4 is embedded in the high-voltage tower 3 with the front end surface 41 and the base end surface 42 opposed outside the high-voltage tower 3. The filled resin 5 (which will also be referred to as a resinous filler) is packed in the case 2 to hermetically seal the primary coil 11 and the secondary coil 12.

In use, the ignition coil 1 is connected to the spark plug 65 mounted in an internal combustion engine for automotive vehicles or cogeneration systems and works to apply high-voltage to the spark plug 65.

In this disclosure, the high-voltage tower 3 of the case 2 has a given length. A direction in which the length of the high-voltage tower 3 extends is referred to as the axial direction Z. The region to which the high-voltage tower 3 protrudes from the case 2 in the axial direction Z is defined as a front end side. The region opposite the front end side in the axial direction Z is defined as a base end side or a rear end side.

The case 2 includes the bottom wall 22 and the tubular side wall 23. The bottom wall 22 expands on a plane extending perpendicular to the axial direction Z. The side wall 23 extends upright from an edge of the bottom wall 22 toward the base end side of the ignition coil 1. The connector 13 is fit in the side wall 23 for achieving connection of the ignition coil 1 to an external device. The bottom wall 22 has formed in a central portion thereof the circular opening 220 which faces in the axial direction Z. The tower mount 21 extends toward the front end side of the ignition coil 1 from an edge of the opening 220 of the bottom wall 22. The tower mount 21 includes the cylindrical wall 211, the annular wall 212, and the fitting wall 213. The cylindrical wall 211 extends from the edge of the opening 220 of the bottom wall 22 toward the front end side of the ignition coil 1. The annular wall 212 extends from the whole circumference of the cylindrical wall 211 inwardly in a direction perpendicular to the axial direction Z. The fitting wall 213 extends from the whole of an inner circumferential edge of the annular wall 212 toward the base end side of the ignition coil 1.

The high-voltage tower 3 is tightly fit in an inner surface of the fitting wall 213 of the tower mount 21. The high-voltage tower 3 and the case 2 are respectively made of discrete parts. The high-voltage tower 3 is attached to the tower mount 21, thereby closing the front end of the case 2, so that a closed inner chamber is defined in the case 2. The inner chamber of the case 2 is filled with the resin 5. After the high-voltage tower 3 is mounted in the case 2 in a production process of the ignition coil 1, the resin 5 is packed in the closed inner chamber of the case 2. The high-voltage tower 3, as described above, serves to output high-voltage, as produced by the secondary coil 12, and is also used to hermetically close the front end of the case 2 to avoid the escape of the filled resin 5 from the case 2. The filled resin 5 is tightly attached to the case 2 and the high-voltage tower 3 to assist in bonding the case 2 and the high-voltage tower 3 together.

Figure 3:
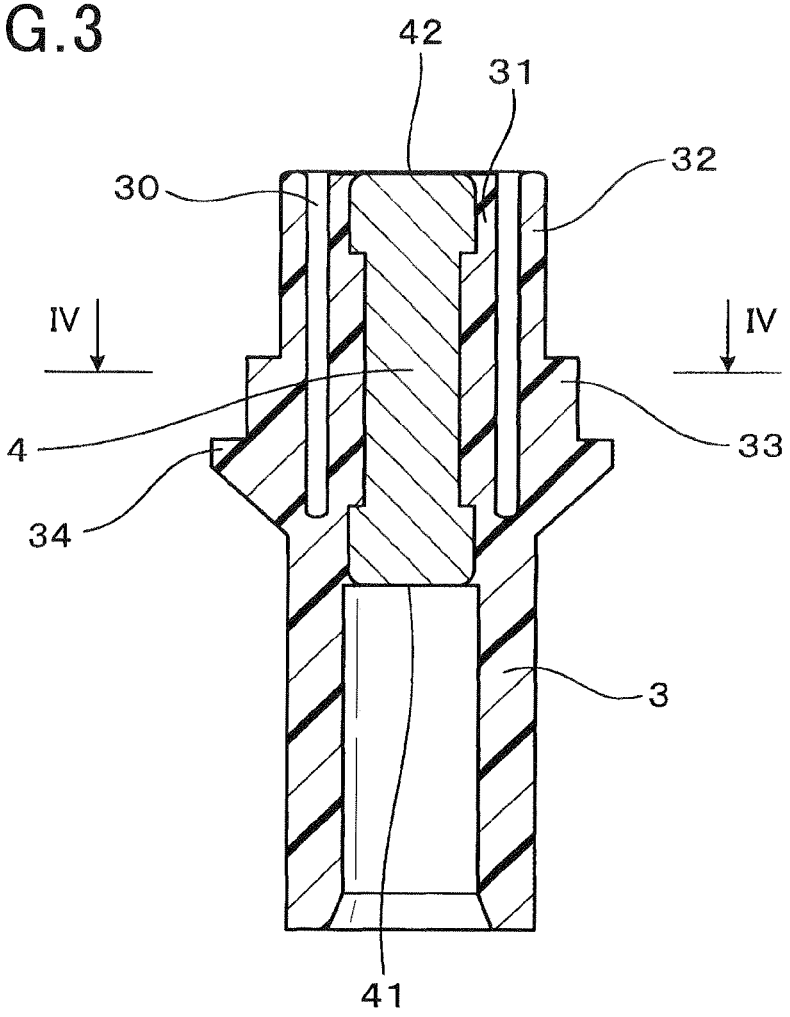
FIG. 3 is a longitudinal sectional view which illustrates a high-voltage tower of the ignition coil of FIG. 1 in which a resistor is embedded.
Figure 4:
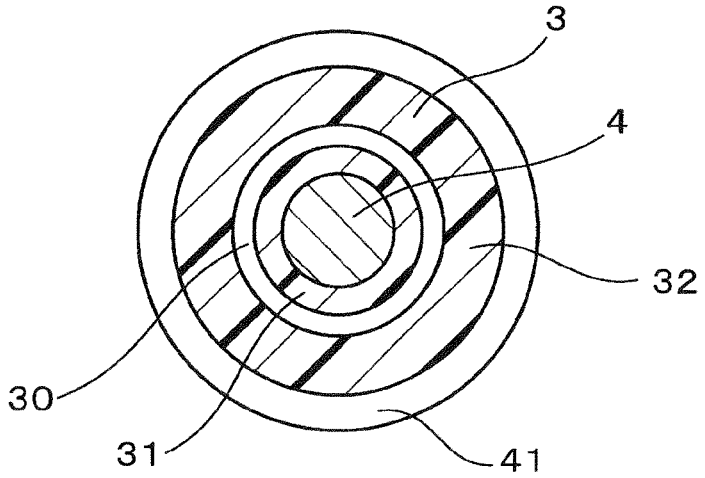
FIG. 4 is a sectional view, as taken along the line IV-IV in FIG. 3.

The high-voltage tower 3 is, as can be seen in FIGS. 2 and 3, of a substantially hollow cylindrical shape and has a length made up of a front portion and a rear portion which extend in alignment in the axial direction Z. The high-voltage tower 3 has the resistor 4 disposed in the rear portion thereof. The high-voltage tower 3 includes the inner cylinder 31 and the outer cylinder 32 which is located outside the inner cylinder 31 in the radial direction of the high-voltage tower 3. The inner cylinder 31 is attached directly to the outer circumference of the resistor 4. The outer cylinder 32 is press-fit in the tower mount 21 of the case 2. The high-voltage tower 3, as illustrated in FIGS. 2 to 4, has the annular groove 30 formed between the inner cylinder 31 and the outer cylinder 32. The annular groove 30 has a closed front end and a rear end which opens at the base end surface of the high-voltage tower 3 and faces the base end side of the ignition coil 1. The annular groove 30 is, as can be seen from FIGS. 1 and 3, filled with the resin 5.

The high-voltage tower 3, as illustrated in FIGS. 2 and 3, has the resistor 4 insert-molded inside the inner cylinder 31. The outer cylinder 32 and the inner cylinder 31 are arranged coaxially with each other. The outer cylinder 32 has a given length made up of a front portion and a base portion (also called a rear portion) which is closer to the base end of the ignition coil 1 than the front portion is. The front portion is greater in outer diameter than the rear portion. The front portion has an outer shoulder (i.e., a large-diameter portion) 33. The high-voltage tower 3, as clearly illustrated in FIG. 2, has the base portion of the outer cylinder 32 (i.e., a portion of the outer cylinder 32 closer to the base end of the high-voltage tower 3 than the outer shoulder 33) fit in the fitting wall 213 of the tower mount 21. Specifically, the high-voltage tower 3 is fitted into the tower mount 21 from outside the front end of the tower mount 21 until the outer shoulder 33 reaches the front end surface of the annular wall 212 of the tower mount 21 of the case 2, thereby positioning the high-voltage tower 3 relative to the case 2 in the axial direction Z, in other words, ensuring the alignment of the high-voltage tower 3 with the case in the axial direction Z.

The annular groove 30 is, as can be seen in FIG. 4, of a ring-shape and surrounds an outer circumference of the resistor 4. The annular groove 30 is, as illustrated in FIGS. 2 and 3, formed to have a width substantially equal to the length of the resistor 4 in the axial direction Z. In other words, the resin 5 packed in the annular groove 30 occupies substantially the same region as that occupied by the resistor 4 in the axial direction Z.

The high-voltage tower 3 also has a stopper 34 shaped in the form of a barbed protrusion which bulges outward in the radial direction of the high-voltage tower 3. The stopper 34 is located to be closer to the front end of the high-voltage tower 3 than the outer shoulder 33 is.

The high-voltage tower 3 in which the resistor 4 is embedded is completed by pulling two discrete molds in opposite directions of the high-voltage tower 3 parallel to the axial direction Z. Specifically, the high-voltage tower 3 has an outer peripheral surface and an inner peripheral surface which are opposed to each other through a thickness thereof. The outer peripheral surface is shaped to have an outer diameter which is at least partially kept constant in the longitudinal direction of the high-voltage tower 3 and/or decreases outwardly in the longitudinal direction of the high-voltage tower 3, i.e., the directions in which the molds are pulled. The inner peripheral surface is shaped to have an inner diameter which is at least partially kept constant in the longitudinal direction of the high-voltage tower 3 and/or increases outwardly in the longitudinal direction of the high-voltage tower 3, i.e., the directions in which the molds are pulled.

The high-voltage tower 3 and the case 2 are different in material from each other. Specifically, the material of the high-voltage tower 3 is higher in stiffness than that of the case 2. For example, the high-voltage tower 3 is made of PPS (Poly Phenylene Sulfide) resin. The case 2 is made of PBT (Poly Butylene Terephtalate) resin. The resin 5 is epoxy resin.

The resistor 4 installed in the high-voltage tower 3 is implemented by, for example, a ceramic cylinder or a winding of electrical conductor. The resistor 4 is embedded in the high-voltage tower, thereby ensuring the position thereof relative to the high-voltage tower 3. The resistor 4 has the front end surface 41 and the base end surface 42 which are exposed outside the inner cylinder 31 of the high-voltage tower 3. The base end surface 42 of the resistor 4 is placed in contact with the connector terminal 18 which electrically leads to the secondary coil 12. In other words, the resistor 4 is electrically connected to the secondary coil 12 through the connector terminal 42. Before the resin 5 is packed in the case 2, the connector terminal 18 is in contact with the base end surface 42 of the resistor 4. Specifically, the connector terminal 18 is kept elastically deformed in contact with the base end surface 42 of the resistor 4. Next, the resin 5 is packed in the case 5 and fully covers the connector terminal 18 to hermetically seal it.

The ignition coil 1 of this embodiment, as illustrated in FIG. 1, also includes the resinous joint 6 and the conductor 7. The joint 6 is secured to the high-voltage tower 3. The conductor 7 is disposed in the joint 6. The joint 6 is of a hollow cylindrical shape and connects the high-voltage tower 3 and the spark plug 65. The conductor 7 electrically connects the resistor 4 and the spark plug 65.

The joint 6 is fit on the high-voltage tower 3 through the rubber seal 14. The rubber seal 14 engages the stopper 34 of the high-voltage tower 3. The rubber seal 14 serves to hermetically seal between the high-voltage tower 3 and the joint 6 and between the ignition coil 1 and an open end of a plug hole of an engine head into which the ignition coil 1 is inserted. The rubber-made plug cap 15 into which the spark plug 65 is inserted is fit on the front end of the joint 6.

The conductor 7 disposed in the joint 6 is made of a coil spring formed by helically winding conductive wire. The conductor 7 is elastically deformable in the axial direction Z. The conductor 7 is aligned coaxially with the joint 6 in the axial direction Z. The conductor 7 is elastically placed in contact with the front end surface 41 of the resistor 4 so as to press the resistor 4 toward the base end of the high-voltage tower 3. When the spark plug 65 is inserted into the plug cap 15, the conductor 7 will contact the base end of the spark plug 65 to achieve electrical connection between the secondary coil 12 and the spark plug 65.

The primary coil 11 and the secondary coil 12 are, as can be seen in FIG. 1, oriented to have inner and outer peripheral walls coaxially laid to overlap each other. The center core 16 is disposed inside the primary coil 11 and the secondary coil 12. The center core 16 is made of soft magnetic material. The outer core 17 is disposed outside the primary coil 11 and the secondary coil 12 and surrounds them in a direction perpendicular to the axial direction Z. The outer core 17 is made of soft magnetic material. The primary coil 11, the secondary coil 12, the center core 16, and the outer core 17 are hermetically sealed by the filled resin 5 within the case 2.

The operation of and beneficial effects, as offered by the ignition coil 1 of this embodiment, will be described below.

The ignition coil 1 is, as described above, designed to have the high-voltage tower 3 fit in the tower mount 21 formed on the front end portion of the case 2. This enables the high-voltage tower 3 to be formed to have the resistor 4 embedded therein separately from the case 2, thus making it possible to produce the assembly of the high-voltage tower 3 and the resistor 4 to be reduced in size as compared with when the high-voltage tower 3 in which the resistor 4 is embedded is formed integrally with the case 2. The structure of the high-voltage tower 3 in which the resistor 4 is installed may, therefore, be designed to be compact and simplified, which will enable the assembly of the high-voltage tower 3 and the resistor 4 to be fabricated in a decreased number of production processes to improve the productivity of the ignition coil 1.

It is also possible to reduce the size of the mold used to form the assembly of the high-voltage tower 3 and the resistor 4, thereby enhancing the mechanical strength of the high-voltage tower 3. Specifically, the cavity of the mold for forming the high-voltage tower 4 in which the resistor 4 is embedded is enabled to be reduced in size and simplified in structure thereof. This minimizes the risk that welds appear when molten resin is poured into the cavity of the mold to form the high-voltage tower 3, thus resulting in an increased mechanical strength of the high-voltage tower 3, which will lead to improved durability of the high-voltage tower 3 against stress arising from a difference in coefficient of linear expansion between the high-voltage tower 3 and the resistor 4.

The enhanced strength of the high-voltage tower 3 also enables the high-voltage tower 3 to be reduced in size itself.

The ignition coil 1 is equipped with the joint 6 and the conductor 7. The joint 6 which is made separately from the high-voltage tower 3 is fit on the high-voltage tower 3, thereby improving the degree of design freedom of a mechanism to connect the high-voltage tower 3 and the spark plug 65 together.

The reduced size of the high-voltage tower 3 makes it easier for the high-voltage tower 3 to have a structure which is formed by pulling the two discrete molds in opposite directions parallel to the axial direction Z, that is, which does not have any undercuts. This further facilitates the ease with which the high-voltage tower 3 is produced, thereby improving the productivity of the high-voltage tower 3.

The high-voltage tower 3 is also equipped with the inner cylinder 31 and the outer cylinder 32. The annular groove 30 is formed between the inner cylinder 31 and the outer cylinder 32. The annular groove 30 is also filled with the resin 5, thus resulting in an increase in area of contact between the filled resin 5 and the high-voltage tower 3. This enhances the strength of joint, as achieved by the resin 5, between the high-voltage tower 3 and the case 2. A portion of the resin 5 which is packed in the annular groove 30 is located at the same position as that of the resistor 4 in the axial direction Z, in other words, it overlaps or surrounds the circumference of the resistor 4 in the radial direction of the resistor 4. This enables the resin 5 to be made of material having a higher electrical insulation than the high-voltage tower 3 to enhance electrical insulation between the resistor 4 and outside the high-voltage tower 3.

The high-voltage tower 3 is made of material which is higher in stiffness than the case 2. The high-voltage tower 3 is usually subjected to the mechanical stress depending upon a difference in linear coefficient of expansion between itself and the resistor 4 and thus required to have a high degree of stiffness. The high-voltage tower 3 is, as described above, formed separately from the case 2 and thus easy to make with material higher in stiffness than the case 2. Conversely, the case 2 which is not required to have a degree of stiffness higher than that of the high-voltage tower 3 may be made of a lower rigidity material to decrease the production cost thereof.

The resistor 4 is embedded in the high-voltage tower 3, thus reducing the risk that the stress, as arising from a difference in linear coefficient of expansion between the filled resin 5 and the resistor 4, is exerted on the resin 5, so that it cracks.

The structure of the ignition coil 1 of this embodiment is, therefore, engineered to have the resistor 4 disposed within the high-voltage tower 3 and enhances the productivity of the ignition coil 1.

Second Embodiment

Figure 5:
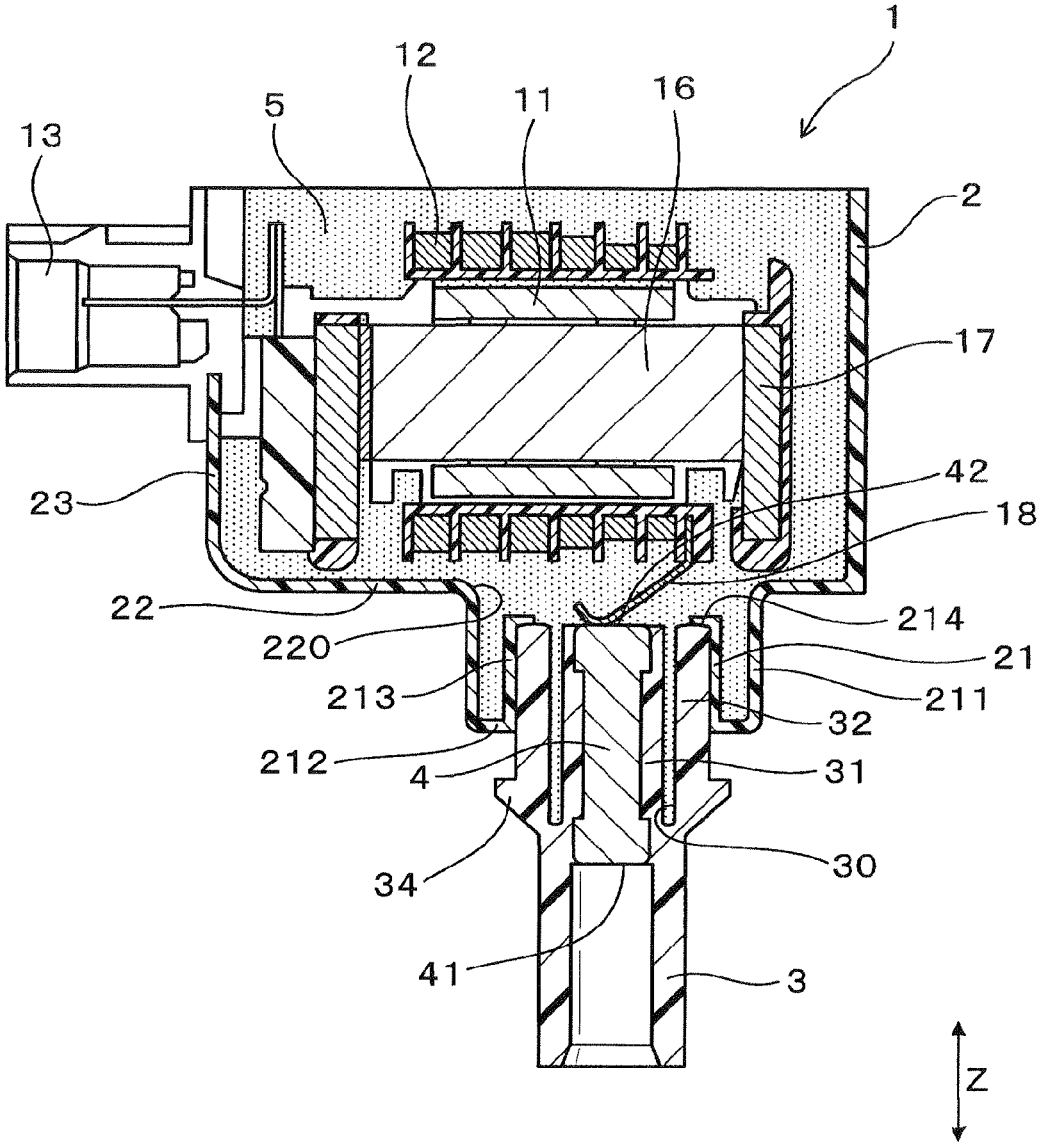
FIG. 5 is a longitudinal sectional view which illustrates an ignition coil according to the second embodiment from which a joint is omitted.

FIG. 5 illustrates the ignition coil 1 according to the second embodiment which is different from the first embodiment in how to position the high-voltage tower 3 relative to the case 2. The same reference numbers, as employed in the first embodiment, will refer to the same parts.

The tower mount 21 has the annular flange 214 extending inwardly from the end of the fitting wall 213. The annular flange 214 serves as a positioner.

The outer cylinder 32 of the high-voltage tower 3 is shaped to have an outer diameter kept constant in the axial direction Z between the base end and the stopper 34. In other words, the high-voltage tower 3 does not have the outer shoulder 33 in the first embodiment, as illustrated in FIG. 1.

The high-voltage tower 3 is, like in the first embodiment, fitted on the tower mount 21 from the front end thereof until the base end of the outer cylinder 32 contacts the front end of the positioner 214 of the tower mount 21, thereby positioning the high-voltage tower 3 relative to the case 2 in the axial direction Z.

Other arrangements are identical with those in the first embodiment.

The same reference numbers in the second and following embodiments, as employed in the first and preceding embodiments, refer to the same parts unless otherwise specified.

The ignition coil 1 of the second embodiment is, as apparent from the above discussion, engineered to secure the positioning of the high-voltage tower 3 relative to the case 2 without the need for the high-voltage tower 3 to have a complicated structure. This further facilitates the ease with which the high-voltage tower 3 is produced.

The second embodiment offers the same other beneficial advantages as those in the first embodiment.

Third Embodiment

Figure 6:
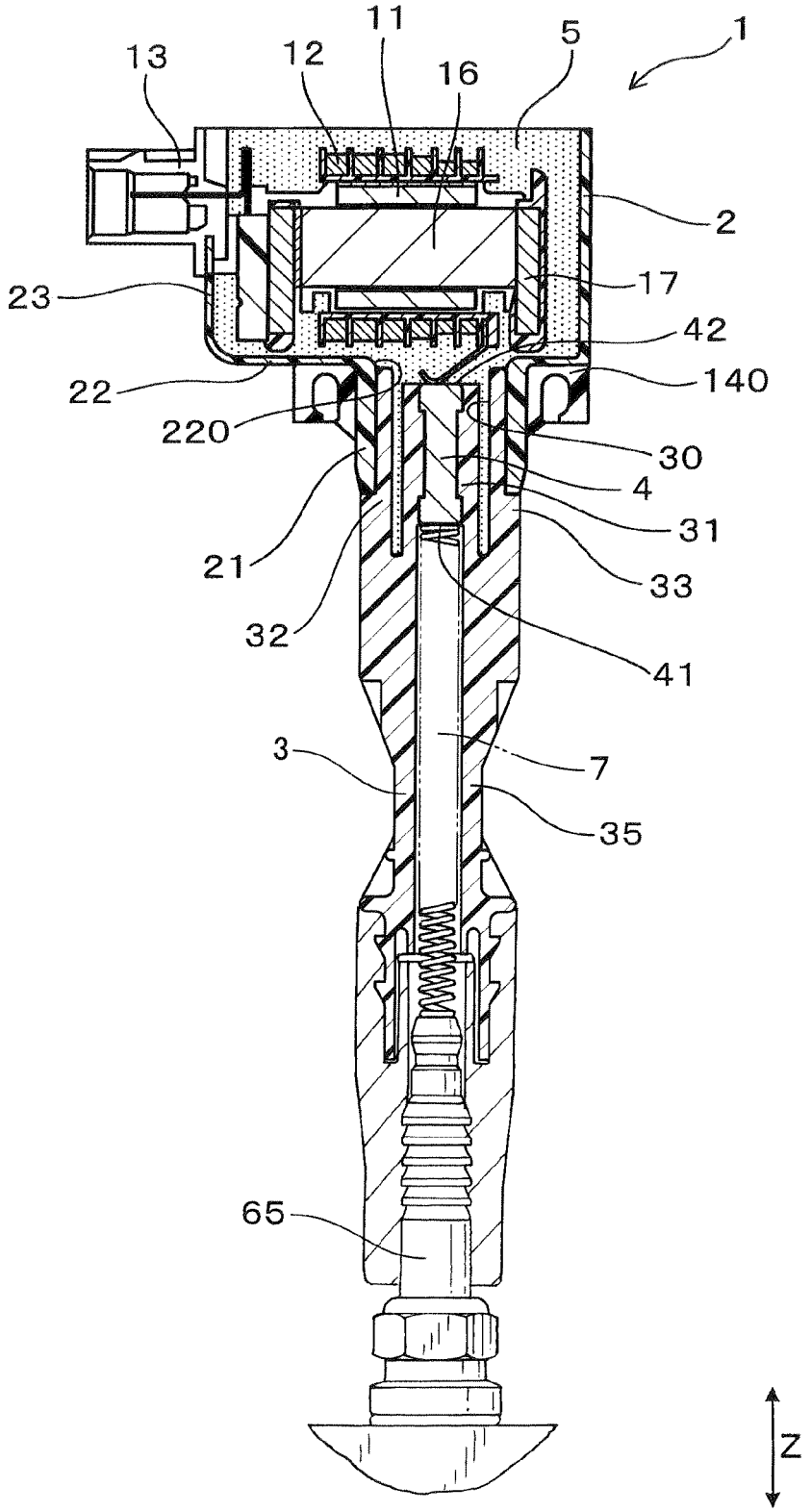
FIG. 6 is a longitudinal sectional view which illustrates an ignition coil according to the third embodiment.
Figure 7:
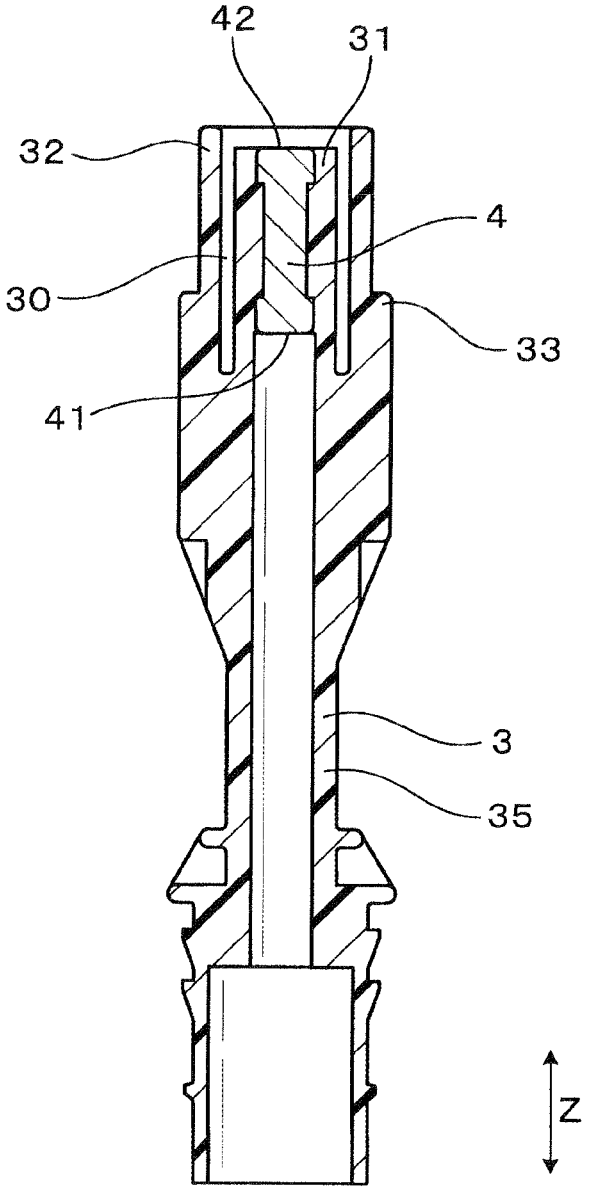
FIG. 7 is a longitudinal sectional view which illustrates a high-voltage tower of the ignition coil of FIG. 6 in which a resistor is embedded.

FIGS. 6 and 7 illustrate the ignition coil 1 according to the third embodiment in which the high-voltage tower 3 has the extension 35 protruding from a major body thereof in the axial direction Z. The extension 35 has disposed therein the conductor 7 which electrically connects the resistor 4 and the spark plug 65. The extension 35 also has the rubber plug cap 15 fit on a front end portion thereof. The high-voltage tower 3 is joined to the spark plug 65 through the plug cap 15.

The base end of the conductor 7 is in contact with the front end surface 41 of the resistor 4. Like in the first embodiment, the conductor 7 is made of a coil spring. The extension 35 of the high-voltage tower 3 extends to the front end side of the ignition coil 1 and surrounds or covers the circumferential surface of the conductor 7. The rubber plug cap 15 is fit on the front end portion of the extension 35 of the high-voltage tower 3. The spark plug 65 is inserted into the plug cap 15 to connect the high-voltage tower 3 and the spark plug 65 together.

The tower mount 21 of the case 2 is of a hollow cylindrical shape which extends from the bottom wall 22 of the case 2 toward the front end of the ignition coil 1. The high-voltage tower 3, like in the first embodiment, has the outer shoulder 33 which is greater in outer diameter than the base portion thereof. The joining of the high-voltage tower 3 to the case 2 is achieved by fitting it into the tower mount 21 from the front end thereof until the shoulder 33 reaches the front end surface of the tower mount 21, thereby positioning the high-voltage tower 3 relative to the case 2 in the axial direction Z.

The annular groove 30 is also formed in the high-voltage tower 3 and extends in the region from the base end of the resistor 4 toward the front end side of the resistor 4 in the axial direction Z. The annular groove 30 is, like in the first and second embodiments, fully filled with the resin 5.

The rubber seal 140 is fit on the front end of the case 2 and hermetically seal between the ignition coil 1 and the open end of the plug hole of the engine head into which the ignition coil 1 is inserted.

Other arrangements are identical with those in the first embodiment.

The high-voltage tower 3 of the ignition coil 1 of the third embodiment, as described above, has the extension 35 which covers the conductor 7 to increase the degree of electrical insulation between the conductor 7 and outside the high-voltage tower 3. In other words, there is no joint of the high-voltage tower 3 with a separate member near a high-potential portion of the conductor 7, thus securing a high degree of electrical insulation between the conductor 7 disposed in the high-voltage tower 3 and outside the high-voltage tower 3.

In the case where the high-voltage tower 3 is fit on or in a resinous member which covers the conductor 7, it is required to arrange a rubber seal between the high-voltage tower 3 and the resinous member to establish hermetical sealing and electrical insulation between them, thus requiring the need for the rubber seal to have a complicated structure. The structure of the ignition coil 1 of this embodiment does not include the above resinous member and thus needs not have the rubber seal to hermetically seal between the high-voltage tower 3 and the resinous member, thus resulting in improved productivity of the ignition coil 1.

The annular groove 30 occupies the region around the circumference of the resistor 4 between the base end and the top end side of the resistor 4 in the axial direction Z and is fully filled with the resin 5, thereby resulting in an increased area of contact between the high-voltage tower 3 and the resin 5 which enhances the mechanical strength of a joint between the high-voltage tower 3 and the case 2 through the resin 5. The increased area of contact between the high-voltage tower 3 and the resin 5 also obviates the risk of pealing of the resin 5 from the high-voltage tower 3. The resin 5 may be made of material whose electrical insulation is higher than that of the high-voltage tower 3 to enhance the degree of electrical insulation between the resistor 4 and outside the high-voltage tower 3.

The structure of the ignition coil 1 of the third embodiment offers the same other beneficial advantages as those in the first embodiment.

The high-voltage tower 3 and the case 2 in the first to third embodiments are, as described above, made of materials different from each other, but may be made of the same material.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. An ignition coil for an internal combustion engine comprising:

a primary coil and a secondary coil which are magnetically coupled together;

a case in which the primary coil and the secondary coil are disposed, the case having a front end and a base end which are opposed to each other, the case also having a tower mount integrally formed on the front end thereof;

a high-voltage tower which is formed separately from the case and is secured to the tower mount of said case;

a resistor which has a front end surface and a base end surface which are opposed to each other, the resistor being embedded in the high-voltage tower with the front and base end surfaces exposed from the high-voltage tower; and resin which is packed within the case to seal the primary coil and the secondary coil.

2. An ignition coil as set forth in claim 1, further comprising a resinous joint and an electrical conductor, the resinous joint being attached to the high-voltage tower for connecting the high-voltage tower and a spark plug together, the electrical conductor being disposed in the joint to electrically connect the resistor and the spark plug.

3. An ignition coil as set forth in claim 1, wherein the high-voltage tower includes an extension extending toward a front end side of the high-voltage tower, the extension having disposed therein an electrical conductor which electrically connects the resistor and a spark plug, the electrical conductor having a front end to which a rubber plug cap is attached, and wherein the high-voltage tower is connectable with the spark plug through the plug cap.

4. An ignition coil as set forth in claim 1, wherein the high-voltage tower includes an inner cylinder attached directly to an outer peripheral surface of the resistor and an outer cylinder which is located outside an outer circumference of the inner cylinder and fit in the tower mount of the case, and wherein the high-voltage tower also has an annular groove formed between the inner and outer cylinders, the annular groove having an open end facing a base end of the high-voltage tower and a closed end facing a front end of the high-voltage tower, the annular groove being filled with the resin.

* * * * *